US005213441A

United States Patent [19]

Baerveldt

[11] Patent Number: 5,213,441

[45] Date of Patent: May 25, 1993

[54] EXTRUDED THERMOPLASTIC ELASTOMER EXPANSION JOINT RETAINER

[75] Inventor: Konrad Baerveldt, Thornhill, Canada

[73] Assignee: Emseal Corporation, Mississauga, Canada

[21] Appl. No.: 689,337

[22] Filed: Apr. 22, 1991

[30] Foreign Application Priority Data

Apr. 24, 1990 [CA] Canada ..... 2015289

[51] Int. Cl.[5] ..... E01C 11/10

[52] U.S. Cl. ..... 404/66; 404/67; 404/69

[58] Field of Search ..... 404/17, 32, 33, 47, 404/53, 56, 64–69, 74; 52/396, 573

[56] References Cited

U.S. PATENT DOCUMENTS

| | | | |
|---|---|---|---|
| 3,363,522 | 1/1968 | Galbreath | 404/67 |
| 3,713,368 | 1/1973 | McDowell et al. | 404/32 |
| 3,750,359 | 8/1973 | Balzer et al. | 404/67 X |
| 4,084,912 | 4/1978 | Pyle et al. | 404/64 X |
| 4,504,170 | 3/1985 | Schukolinski | 404/67 X |
| 4,572,702 | 2/1986 | Bone | 404/67 X |
| 4,774,795 | 10/1988 | Braun | 404/68 X |
| 4,815,247 | 3/1989 | Nicholas | 404/47 X |

*Primary Examiner*—Terry Lee Melius
*Assistant Examiner*—Roger J. Schoeppel
*Attorney, Agent, or Firm*—Baker & Daniels

[57] ABSTRACT

An expansion joint retainer is used in fastening a flexible elastomeric seal or strip seal to a structural slab. The retainer has a main body made from a first material. The main body has a thickness selected to permit emplacement of the retainer on the edge of a said slab whereby the upper surface of the main body is substantially coplanar with or beneath the upper traffic bearing surface of the slab. The retainer includes a retaining element adjacent the lower surface of the main body. The retaining element is made of a second material serving to provide the retainer with sufficient rigidity to be bolted to a slab. The invention is characterized in that the second material is a thermoplastic elastomer.

17 Claims, 3 Drawing Sheets

EXTRUDED THERMOPLASTIC ELASTOMER EXPANSION JOINT RETAINER

The present invention relates to the field of expansion joints for use in connection with parking decks, bridges, and other installations where a flexible water resistant seal is desired to span the joint between concrete or other structural slabs.

An expansion joint is generally made up of three pieces: a flexible elastomeric seal that spans a joint, and a pair of expansion joint retainers, also called "nosings" fastened to the edges of the slabs being joined over the flexible seal. Before a joint can be spanned with such an expansion joint configuration, rectangular grooves must be cut or formed in the upper surfaces of the slabs, along the adjacent edges thereof. Then, at regular intervals, anchor bolts must be set in the grooves. The flexible seal is then laid down. It sits in the grooves on each slab, and may be additionally adhesively fastened to the surface of the slabs in the groove. Apertures are formed in the elastomeric seal, either during the manufacture thereof, or on the job site, at locations corresponding to the positions of the anchor bolts, so that the seal may fit over the anchors. The nosings, which are also provided with apertures formed therein at the positions of the anchor bolts, are then laid over the seal and bolted down. The nosings are typically fabricated from a durable high density polymer material such as NEOPRENE TM from DuPont. The nosings also include a steel mounting plate molded into the NEOPRENE near the lowermost surface thereof. The function of the plate is to ensure that the nosing remains firmly bolted to the deck joint. The steel plate also keeps the nosing rigid, and protects it against damage caused by torsional forces such as those that can occur when a heavy vehicle passes over part of a joint, flexing it over only a portion of its width.

The drawback associated with including a steel plate in the nosing is that it makes it necessary to mold the nosings in discrete segments, with the steel insert set in the nosing during the molding process. The steel plate also makes it difficult to cut the nosing to size on a job site.

Examples of various expansion joints are shown in U.S. Pat. Nos. 4,362,430; 4,456,398; 4,378,176; 4,140,419; 4,007,994; 3,880,539; 3,880,540; 3,850,539; and 4,362,429; and Canadian Patents 1,159,672, 1,064,301, 1,064,302; and 1,060,693.

The object of the present invention is to provide an improved nosing for flexible expansion joint, and thereby provide an improved expansion joint.

A further object of the present invention is to provide an extrudable nosing with an integrally formed stiffening and reinforcing portion.

A further object of the present invention is to provide a nosing which may be manufactured to any desired length, and also cut at a job site relatively easily In a broad aspect, the present invention relates to an expansion joint retainer for use in fastening a flexible elastomeric seal or strip seal to a structural slab, said retainer having a main body made from a first material, said main body having a thickness selected to permit emplacement of said retainer on the edge of a said slab whereby the upper surface of said main body is substantially coplanar with or beneath the upper traffic bearing surface of said slab; said retainer including a retaining element adjacent the lower surface of the said main body, said retaining element being made of a second material serving to provide said retainer with sufficient rigidity to be bolted to said slab, characterized in that said second material is a thermoplastic elastomer.

In another broad aspect, the present invention relates to a method of manufacturing an expansion joint retainer for use in fastening an elastomeric seal or strip seal to a structural slab, said retainer having a main body made from a first material, said main body having a thickness selected to permit emplacement of said retainer on the edge of a said slab whereby the upper surface of said main body is substantially coplanar with or beneath the upper traffic bearing surface of said slab; said retainer including a retaining element adjacent the lower surface of the said main body, said retaining element being made of a second material serving to provide said retainer with sufficient rigidity to be bolted to said slab, characterized in that said second material is a thermoplastic elastomer characterized in that said first and second materials are co-extruded to provide a retainer of any desired length having a main body integral with a retaining element.

In drawings which illustrate the present invention by way of example:

Figure 1:
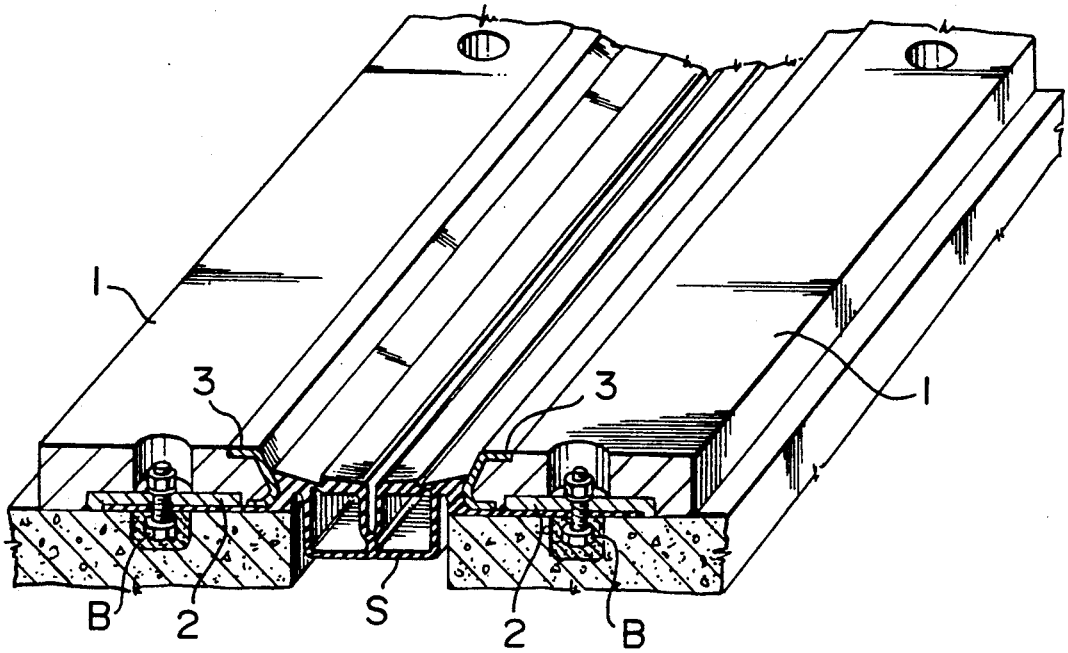
FIG. 1 is a perspective view of a joint, in cross section, incorporating the present invention.
Figure 2:
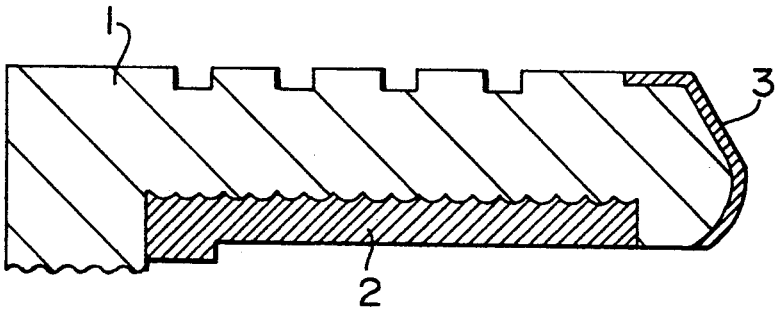
FIG. 2 is a cross sectional view of a typical nosing of the present invention.

Referring first to FIGS. 1 and 2, the present invention provides a nosing for flexible expansion joint for spanning the gap between adjacent slabs of, for instance, a parking deck or bridge deck. A joint utilizing the present invention includes a flexible strip seal S made from a flexible elastomeric material. Suitable materials for construction of the elastomeric seal include NEOPRENE TM (chloroprene), silicone rubber, SANTOPRENE TM (thermoplastic rubber), EPDM, KRATON TM (thermoplastic elastomer), and so on.

As can be seen from the figures, the slabs adjacent the joint along the edges, have a rectangular groove formed therein. The sealing strip S is laid on the lowermost surface of the groove, and may be additionally fastened thereto with an adhesive, such as an epoxy resin.

At regular intervals in each groove are positioned anchor bolts B, or threaded bolts, embedded into the slab in the groove. The anchor bolts extend through apertures in the strip seal, and similar apertures in the nosings which will be described.

Each nosing is dimensioned to fit in a typically dimensioned groove in the slab, and is manufactured as a co-extrusion of a main body element 1 made from a thermoplastic rubber material such as SANTOPRENE TM by Monsanto Company and a retaining element 2 made from a higher durometer thermoplastic material such as medium, high, or ultra high density polyethylene. The material of the retaining element will be chemically and thermally fused to that of the main element during the co-extrusion process, and will become integral with the main body, thereby providing a one piece nosing which may be extruded rather than molded. Accordingly, the nosings of the present invention may be provided in any desired length.

It will be seen from the drawings that the anchor bolt B extends through pre-drilled holes in the retaining element. Above such predrilled holes, the material of the main element is bored away to permit emplacement and tightening of a washer and a nut on the anchor bolt.

A deflector element 3 of the same material as the retainer may also be co-extruded as an integral part of the nosing. This deflector protects the relatively more pliable material of the main body of the nosing from being damaged by snowplows.

Figure 3:
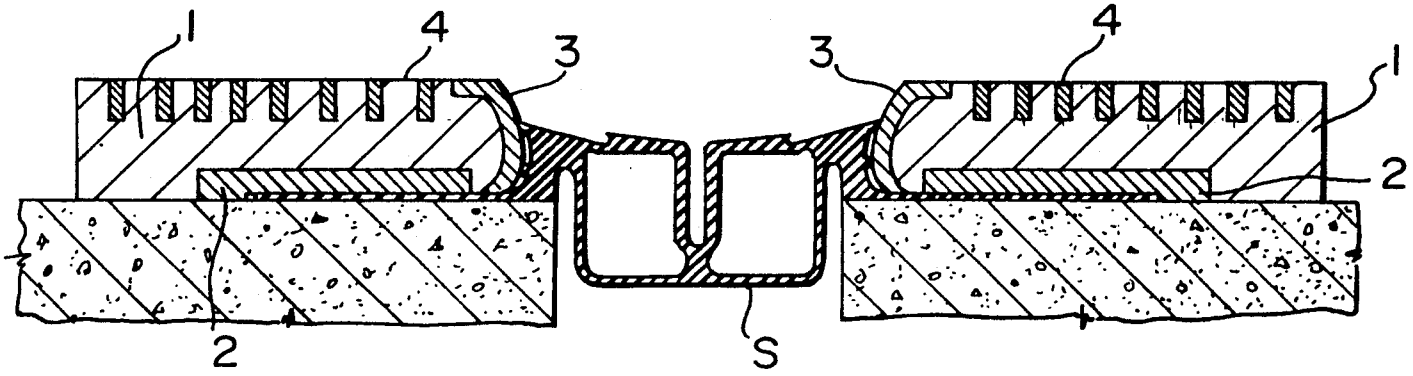
FIG. 3 is a cross sectional view of a joint incorporating a further embodiment of the present invention.

Referring to FIG. 3, it will be seen that abrasion resistant strips 4 of the medium or high density polyethylene material of the retaining element may be co-extruded on the top surface of the main element. This will increase the expected life span of the nosing without significantly altering its important impact absorbing characteristics.

Figure 4:
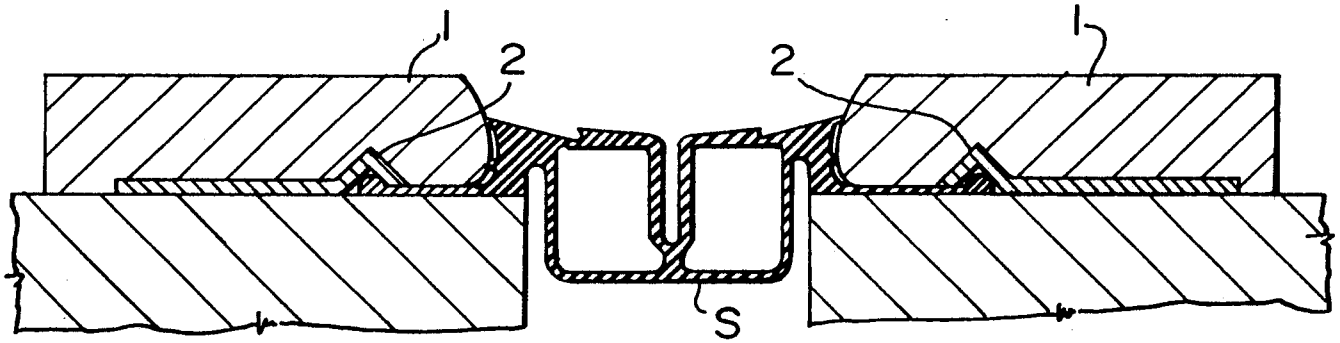
FIG. 4 is a cross sectional view of a joint incorporating another embodiment of the present invention.

Turning to FIG. 4, an embodiment suitable for use in situations where it is anticipated that one may have to change strip seals frequently (for instance a bridge with a high traffic volume) is shown. In this embodiment, the undersurface of the retaining element is shaped as a clip to grip a bead on the edge of the strip seal and clamp it in place. In such a case, the strip is not penetrated by the anchor bolt, and so can be removed by loosening the bolts just enough to pull the strip free. A new strip can then be tucked into place, and the anchor bolts retightened.

Figure 5:
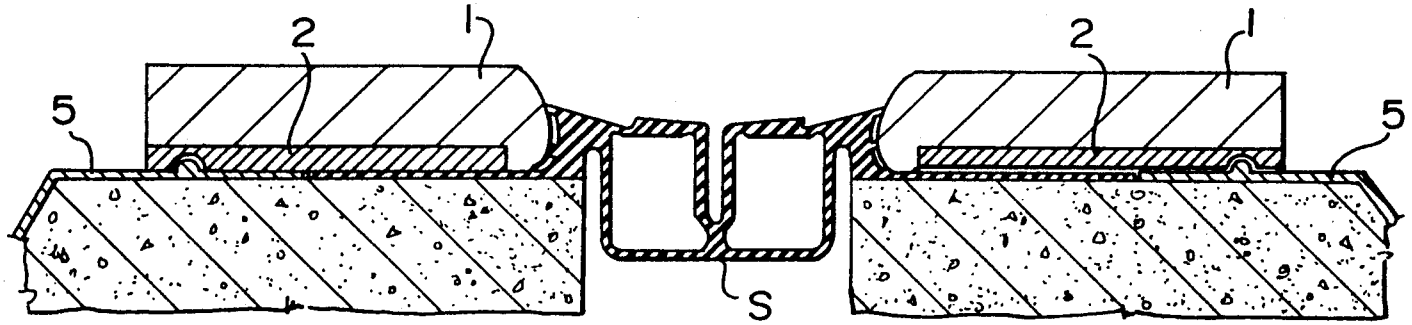
FIG. 5 is a cross sectional view of a joint incorporating yet a further embodiment of the present invention.

In FIG. 5, an embodiment which maintains the integrity of a deck waterproofing system is shown. A flexible side membrane 5 is provided under the retaining element, held in place by a groove 6 in the retaining element dimensioned to fit over a bead in the membrane. The membrane extends out of the rectangular groove in the slab, and may then be adhesively fixed to the deck. Alternately, the membrane may be heat welded to the retaining element, but a groove/bead system is preferred, as it permits changing either the membrane or the nosing without damaging the other.

Figure 6:
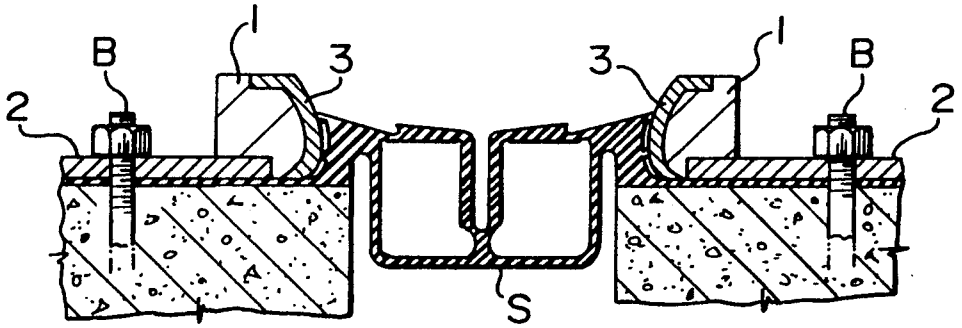
FIG. 6 is a cross sectional view of a joint incorporating yet a further embodiment of the invention.

Referring to FIG. 6, there is shown an embodiment of the present invention which takes advantage of the integral nature of the main body and retaining elements which results from the thermal and chemical fusing of same during co-extrusion. As can be seen from FIG. 6, in this form, the portion of the main body remote from the joint gap is eliminated, and only enough main body material is provided to overlap the retaining element and bond thereto. This form of the invention is useful in situations where, for instance, an asphalt top coat is laid on a concrete base. It is unnecessary to form any groove in the concrete utilizing this embodiment. All that is done is, after the anchor bolts are embedded in the edge of the concrete, the elastomeric seal is set own in a nosing having a height substantially equal to the desired depth of asphalt, and constructed according to FIG. 6 is bolted into place over the seal. Asphalt is then applied to the desired depth, directly over the retaining element and up to the edge of the top surface of the main body.

Suitable materials for manufacturing the main element include Monsanto Santoprene 121-80 and 121-73. Other suitable materials will be evident to one skilled in the art. The retainer element (as well as those other elements made from the same material, as mentioned above) may be made from a mid to high molecular weight polyethylene. However, other suitable materials having rigidity, abrasion resistance and compatibility with the main element required will be evident to one skilled in the art.

It is to be understood that the examples described above are not meant to limit the scope of the present invention. It is expected that numerous variants will be obvious to the person skilled in the sealant design art, without any departure from the spirit of the present invention. The appended claims, properly construed, form the only limitation upon the scope of the present invention.

I claim:

1. An expansion joint retainer for use in fastening a flexible elastomeric seal or strip seal to a structural slab, said retainer having a main body made from a first material, said main body having a thickness selected to permit emplacement of said retainer on the edge of a said slab whereby the upper surface of said main body is substantially coplanar with or beneath the upper traffic bearing surface of said slab; said retainer including a retaining element adjacent the lower surface of the said main body, said retaining element being made of a second material serving to provide said retainer with sufficient rigidity to be bolted to said slab, characterized in that said second material is a thermoplastic elastomer.

2. An expansion joint retainer as described in claim 1, further characterized in that said retaining element defines a substantial portion of the lowermost surface of said retainer.

3. An expansion joint retainer as described in claim 2, further characterized in that said retaining element is fused to said main body.

4. An expansion joint retainer as described in claim 3, further characterized in that said main body is made from a thermoplastic rubber.

5. An expansion joint retainer as described in claim 4, further characterized in that said retaining element is formed as a co-extrusion with said body, whereby it is fused with said main body thermally and chemically.

6. An expansion joint retainer as described in claim 4, further characterized in that said retaining element is formed as a co-extrusion with said body by means of conventional thermoplastic extrusion equipment, whereby it is fused with said main body thermally and chemically.

7. An expansion joint retainer as described in claim 5, further characterized in that said retaining element is formed as a plate on the lower surface of said main body.

8. An expansion joint retainer as described in claim 7, further characterized in that said retaining element is formed from mid to high molecular weight polyethylene.

9. An expansion joint retainer as described in claim 8, wherein said main body is formed from SANTOPRENE TM thermoplastic rubber.

10. An expansion joint retainer as described in claim 5, further characterized in that the front surface of said main body is provided with a further layer of said second material, to provide impact resistance thereto.

11. An expansion joint retainer as described in claim 5, further characterized in that the upper surface of said main body is provided with one or more strips of said second material to provide abrasion resistance thereto.

12. An expansion joint retainer as described in claim 5, wherein said retaining element is provided with means to permit the securement of same to a waterproof membrane.

13. An expansion joint retainer as described in claim 9, further characterized in that the front surface of said main body is provided with a further layer of said second material, to provide impact resistance thereto.

14. An expansion joint retainer as described in claim 13, further characterized in that said further layer of said second material is co-extruded with said main body and said retaining element, whereby all parts of said retainer are integral with one another.

15. An expansion joint retainer as described in claim 1, further characterized in that the upper surface of said main body is provided with one or more strips of said second material to provide abrasion resistance thereto.

16. An expansion joint retainer as described in claim 15, further characterized in that said one or more strips of said second material are co-extruded with said main body and said retaining element whereby all parts of said retainer are integral with one another.

17. An expansion joint retainer as described in claim 1, wherein said retaining element is provided with means to permit the securement of same to a waterproof membrane.

* * * * *